US005894242A

United States Patent [19]

Fujimoto

[11] Patent Number: 5,894,242

[45] Date of Patent: Apr. 13, 1999

[54] DRIVE IC FOR PIEZOELECTRIC ELEMENTS OF INK JET PRINTER

[75] Inventor: Hisayoshi Fujimoto, Ukyo-ku, Japan

[73] Assignee: Rohm Co., Ltd., Kyoto, Japan

[21] Appl. No.: 08/734,873

[22] Filed: Oct. 22, 1996

[30] Foreign Application Priority Data

Oct. 23, 1995 [JP] Japan ..... 7-274183

[51] Int. Cl.[6] ..... B41J 2/005

[52] U.S. Cl. ..... 327/407; 327/545; 347/11; 347/211

[58] Field of Search ..... 327/407–413, 327/415–417, 545–547; 307/43, 64, 65; 347/10, 11, 128, 162, 211, 247

[56] References Cited

U.S. PATENT DOCUMENTS 5,245,230 9/1993 Ohri et al. ..... 327/546
5,305,024 4/1994 Moriguchi et al. ..... 346/140 R
5,444,464 8/1995 Endo ..... 347/195
5,455,534 10/1995 Motegi et al. ..... 327/546
5,642,128 6/1997 Inoue ..... 345/96
5,650,802 7/1997 Suzuki et al. ..... 347/9

FOREIGN PATENT DOCUMENTS

WO 95/16568 6/1995 Japan ..... B41J 2/045

*Primary Examiner*—Tuan T. Lam
*Attorney, Agent, or Firm*—Michael D. Bednarek; Kilpatrick Stockton LLP

[57] ABSTRACT

A drive IC is provided for suitably driving piezoelectric elements of an ink jet printer. The drive IC includes a plurality of drive output pads, a plurality of data input pads for feeding plural kinds of drive data, a plurality of shift registers each connected to a corresponding one of the data input pads, a plurality of analog switches connected to each of the drive output pads, and a selecting circuit for selectively feeding one of plural kinds of drive voltages to each of the drive output pads through a selected one of the analog switches according to the drive data.

5 Claims, 3 Drawing Sheets

DRIVE IC FOR PIEZOELECTRIC ELEMENTS OF INK JET PRINTER

BACKGROUND OF THE INVENTION

1. Field of the Invention

The present invention relates to a drive IC which is used to actuate piezoelectric elements for discharging droplets of ink from selected nozzle ports of an ink Jet printhead.

2. Description of the Related Art

Ink jet printers are widely used as a recording device. Typically, an ink jet printer incorporates, a printhead which relies on piezoelectric elements for discharging droplets of ink, and the piezoelectric elements are operated by a group of ICs.

PCT Publication No. WO 95/16568 (corresponding to U.S. patent application Ser. No. 08/505,207 filed Aug. 14, 1995) discloses an ink jet printhead operated by a drive IC which is designed to supply a drive voltage to each of the piezoelectric elements for discharging a droplet of ink when the corresponding bit of the printing data is "1". The drive IC is also designed to supply a standby voltage to each of the piezoelectric elements when the corresponding bit of the printing data is "0". When applied, the standby voltage causes a slight deformation of the piezoelectric element only to prepare for a subsequent larger deformation of the piezoelectric element, but does not cause discharging of ink. Thus, only a single kind of drive voltage is utilized for making a constantly sized droplet of ink.

On the other hand, when an ink jet printer is used to print an image with a gradation like a photograph, the gradation need be represented by changing the density of printing dots. Specifically, a thicker portion of the image may be represented by increasing the dot density, whereas a thinner image portion may be represented by decreasing the dot density. However, a decrease of the dot density makes the individual dots visually outstanding, so that an unnatural image may result particularly with respect to color printing.

The individual dots may be rendered non-outstanding by decreasing the size of the dots. However, if the size of the individual dots is reduced, an increased amount of drive data is required for a unit area of the image. For instance, if the diameter of the dots is halved, the dot area becomes ¼, requiring four times as much data and time.

Thus, the drive IC disclosed in the above-described PCT publication, due to the adoption of a single kind of drive voltage, suffers a problem of requiring a longer time if the size of the individual dots are reduced to improve the gradation of the printed image. For instance, about 14–25 minutes are required for performing full color printing on an A4-size paper with a density of 720 dpi.

SUMMARY OF THE INVENTION

It is, therefore, an object of the present invention to provide an ink jet printer drive IC which is capable of improving the gradating ability of the printer while realizing a reduction of the printing time.

According to one aspect of the present invention, there is provided a drive IC for driving piezoelectric elements of an ink jet printer comprising: a plurality of drive output pads; and means for selectively feeding one of plural kinds of drive voltages to each of the drive output pads.

With the drive IC described above, one kind of the drive voltages may be a lower voltage for forming a smaller printing dot (e.g. 50 μm dot), whereas another kind of the drive voltages may be a higher voltage for forming a larger printing dot (e.g. 100 μm dot). Thus, the ink jet printer may be operated to form larger printing dots for a thicker image portion and smaller printing dots for a thinner image portion. In other words, the thicker image portion can be formed by a smaller number of larger printing dots without any need for decreasing the printing pitch (i.e., increasing the printing time and the number of drive data). whereas the thinner image portion can be formed by smaller printing dots without making the dots outstanding.

According to a preferred embodiment of the present invention, there is provided a drive IC for driving piezoelectric elements of an ink jet printer comprising: a plurality of drive output pads; a plurality of data input pads for feeding plural kinds of drive data; a plurality of shift registers each connected to a corresponding one of the data input pads; a plurality of analog switches connected to each of the drive output pads; and selecting means for selectively feeding one of plural kinds of drive voltages to each of the drive output pads through a selected one of the analog switches according to the drive data.

Preferably, the drive IC may further comprise an additional analog switch connected to each of the drive output pads. In this case, the selecting means serves to apply a standby drive to each of the drive output pads when neither of the drive voltages is fed to said each drive output pad.

Typically, the drive IC may further comprise a plurality of latch circuits each connected to a corresponding one of the shift registers for latching the drive data and for simultaneously feeding the latched drive data to the selecting means upon input of a strobe signal, and a plurality of data output pads each connected to a corresponding one of the shift registers for serial output of the drive data to a following drive IC.

Further, it is advantageous if the selecting means further comprises means for exclusively feeding a predetermined one of the plural kinds of drive voltages to each of the drive output pads when corresponding bits of the plural kinds of drive data are equally an ON-signal in error.

Other objects, features and advantages of the present invention will become apparent from the following description of the preferred embodiment given with reference to the accompanying drawings.

DETAILED DESCRIPTION OF THE PREFERRED EMBODIMENTS

Figure 1:
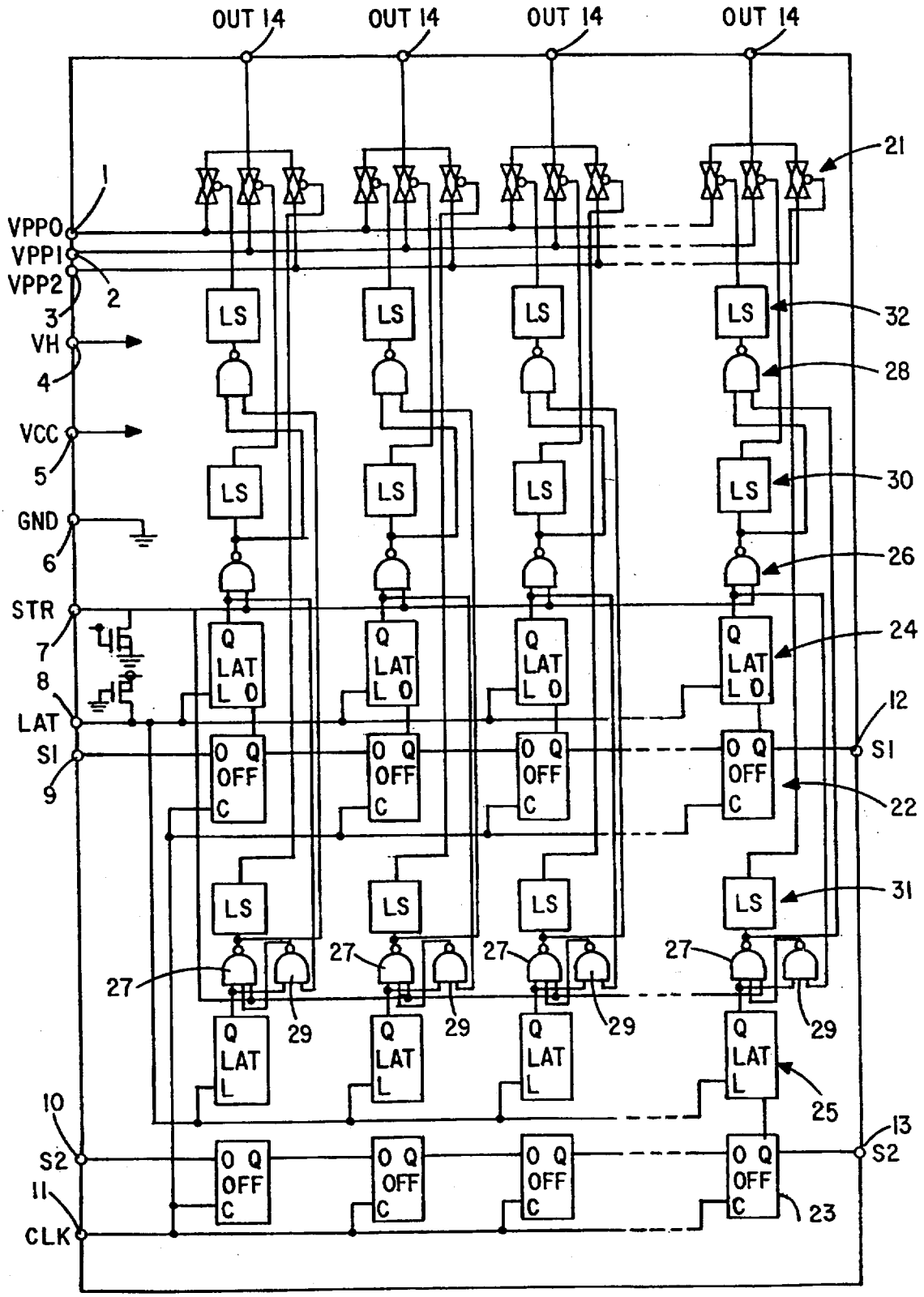
FIG. 1 is a block circuit diagram of a drive IC embodying the present invention.

FIG. 1 of the accompanying drawings illustrates an exemplary circuit design of a drive IC for driving piezoelectric elements of an ink jet printer according to the present invention. The drive IC includes a standby voltage input pad 1 for feeding a standby voltage VPP0, a first drive voltage input pad 2 for feeding a first drive voltage signal VPP1 having a peak voltage higher than the standby voltage VPP0, a second drive voltage input pad 3 for feeding a second drive voltage signal VPP2 having a peak voltage higher than the peak voltage of the first drive voltage signal VPP1, an isolation voltage input pad 4 for feeding an isolation voltage VH of about 30V required for preventing the drive IC from operationally disturbed by the outside elements, a logic power input pad 5 for feeding an operational voltage VCC of about 5V required for operating various logic elements of the drive IC, and a grounding pad 6 serving as a ground terminal GND.

The drive IC also includes a strobe signal input pad 7 for feeding strobe signals STR, a latch signal input pad 8 for feeding latch signals LAT, a first data input pad 9 for feeding sets of primary data S1, a second data input pad 10 for feeding Sets of secondary data S2, a clock signal input pad 11 for feeding clock signals CLK, a first data output pad 12 for serial output of the primary data S1, a second data output pad 13 for serial output of the secondary data S2, and a plurality of drive output pads 14 (64 drive output pads in the illustrated example) for selective output of either one of the standby voltage VPP0, the first drive voltage VPP1 and the second drive voltage VPP2.

Selected one of the standby voltage VPP0, the first drive voltage VPP1 and the second drive voltage VPP2 is supplied to each of the drive output pads 14 by means of analog switches 21. According to the illustrated example, there are a total of 192 analog switches 21 in 64 groups each including three switches.

The primary data S1 supplied via the first data input pad 9 are serially supplied to a first shift register 22 which includes a total of 64 flip-flops in the present embodiment. Similarly, the secondary data S2 supplied via the second data input pad 10 are serially supplied to a second shift register 23 which also includes 64 flip-flops.

A first latch circuit 24 including a total of 64 flip-flops is provided for retaining the respective flip-flop outputs of the first shift register 22 when a latch signal LAT is supplied via the first latch signal input pad 8. Similarly, a second latch circuit 25 also including 64 flip-flops is provided for retaining the respective flip-flop outputs of the second shift register 23 upon input of the latch signal LAT.

A first group of 64 NAND circuits 26 is provided for calculating the negative logical product of a strobe signal STR (supplied via the strobe signal input pad 7) and the respective flip-flop outputs of the first latch circuit 24. Similarly, a second group of 64 NAND circuits 27 is provided for calculating the negative logical product of the strobe signal STR and the respective flip-flop outputs of the second latch circuit 25. Moreover, a third group of 64 NAND circuits 28 is provided for calculating the negative logical product of the respective outputs of the first group NAND circuits 26 and the respective outputs of the second group NAND circuits 27. Further, a fourth group of NAND circuits 29 is provided for calculating the negative logical product of the respective flip-flop outputs of the first latch circuit 24 and the respective flip-flop outputs of the second latch circuit 25.

A first group of 64 level shift circuits 30 is provided for turning on one of the three analog switches 21 in the respective switch groups to feed the first drive voltage signal VPP1 to the drive output pad 14 when the output of the relevant first group NAND circuit 26 is at the low level. Similarly, a second group of 64 level shift circuits 31 is provided for turning on another of the three analog switches 21 in the respective switch groups to feed the second drive voltage signal VPP2 to the drive output pad 14 when the output of the relevant second group NAND circuit 27 is at the low level. Further, a third group of 64 level shift circuits 32 is provided for turning on the remaining one of the three analog switches 21 in the respective switch groups to feed the standby drive voltage signal VPP0 to the drive output pad 14 when the output of the relevant third group NAND circuit 28 is at the low level.

Figure 2:
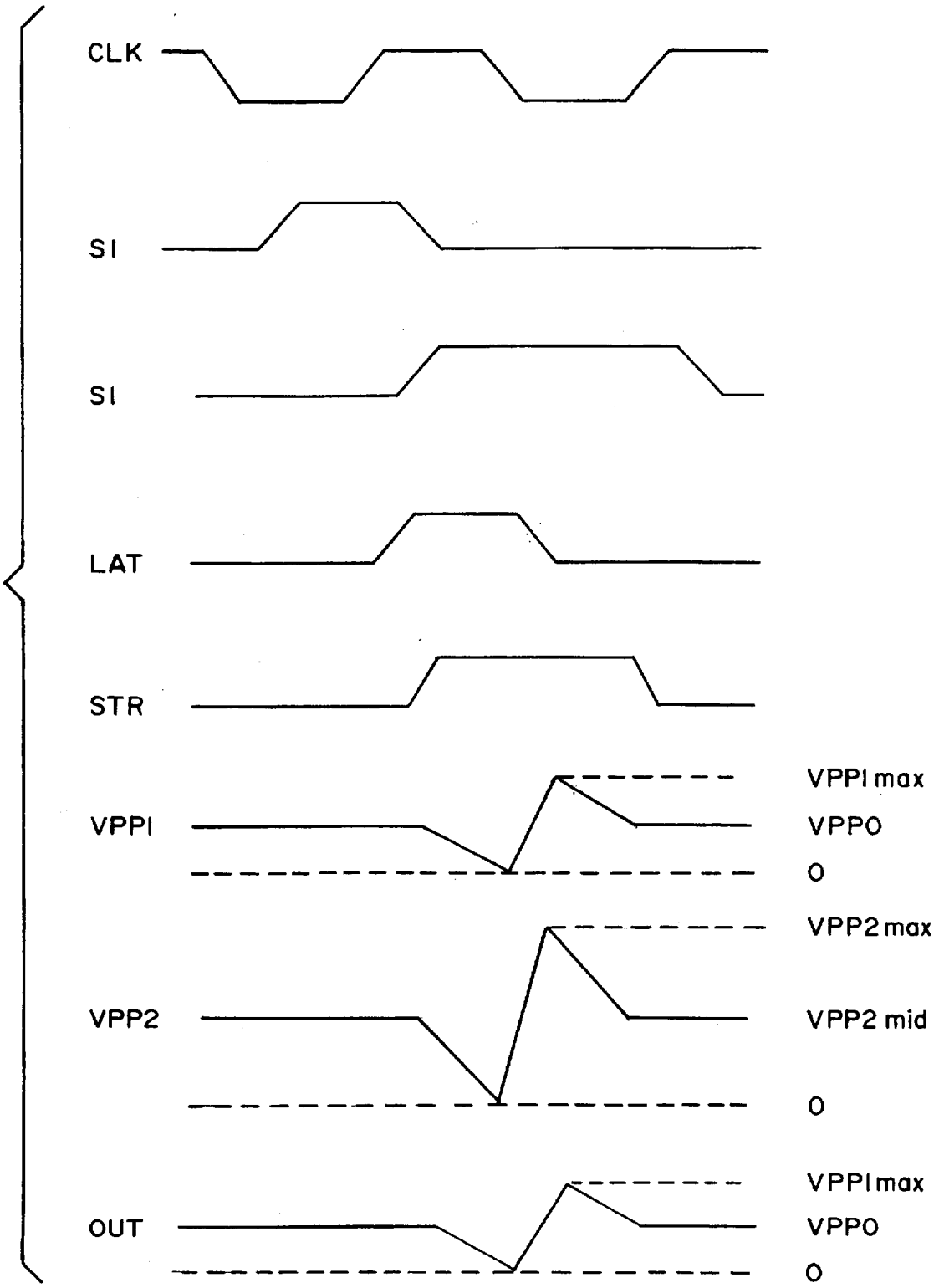
FIG. 2 is a signal timing chart for controlling the same drive IC.

FIG. 2 is a timing diagram showing various input and output signals of the above-described drive IC. Specifically, FIG. 2 illustrates clock signals CLK fed via the clock signal input pad 11, a primary data S1 fed via the first data input pad 9, another primary data S1 taken out via the first data output pad 12, a latch signal LAT fed via the latch signal input pad 8, a strobe signal STR fed via the strobe signal input pad 7, a first drive voltage signal VPP1 fed via the first drive voltage input pad 2, a second drive voltage signal VPP2 fed via the second drive voltage input pad 3, and a drive output OUT from one of the drive output pads 14. It should be appreciated that the input primary data is different from the output primary data because the latter is used for input to a following drive IC (not shown) Indeed, when the ink jet printer includes a plurality of drive ICs connected in series, the first and second data output pads 12, 13 of one drive IC are connected in cascade to the first and second data input pads 9, 10 of a following drive IC, respectively, for serial transmission of the primary and second data S1, S2 from one drive IC to another.

In operation, clock signals CLK are supplied to the clock signal input pad 11 of the drive IC from the control unit of an unillustrated ink jet printer for input to the timing input terminal of the respective flip-flops of the first and second shift registers 22, 23. A set of primary data S1 (64 bits) is serially supplied from the control unit for input to the respective flip-flops of the first shift register 22 in timed relation to the clock signals CLK, so that the set of primary data S1 is temporarily memorized in the first shift register 22. Similarly, a set of secondary data S2 (64 bits) is serially supplied from the control unit for input to the respective flip-flops of the second shift register 23 in timed relation to the clock signals CLK, so that the set of secondary data S2 is temporarily memorized in the second shift register 23.

Then, a latch signal LAT is fed to the latch signal input pad 8 from the control unit of the printer for input to the respective flip-flops of the first and second latch circuits 24, 25. Synchronized with a rise of the latch signal LAT, the primary data S1 memorized in the first shift register 22 are parallelly latched by the respective flip-flops of the first latch circuit 24 for input to a first input terminal of the respective first group NAND circuits 26. Similarly, the secondary data S2 memorized in the second shift register 23 are parallelly latched by the respective flip-flops of the second latch circuit 25 for input to a first input terminal of the respective second group NAND circuits 27. In the meantime, a following set of primary data S1 and a following set of secondary data S2 are temporarily memorized in the first and second shift registers 22, 23, respectively, in the same manner as already described.

Then, a strobe signal STR is fed to the strobe signal input pad 7 for input to a second input terminal of the respective first group NAND circuits 26 as well as a second input terminal of the respective second group NAND circuits 27. At this time, the latch signal LAT is held at the high level, and those bits of the primary data S1 assigned to form printing dots are also held at the high level. Thus, upon a rise of the strobe signal STR to the high level, those of the first group NAND circuits 26 corresponding to the high level bits of the primary data S1 produce a low level signal, whereas the remaining ones of the first group NAND circuits 26 corresponding to the low level bits of the primary data S1 produce a high level signal. It should be noted that each of the second group NAND circuits 27 further has a third input terminal which is connected to an output terminal of a corresponding fourth group NAND circuit 29.

The outputs of the first group NAND circuits 26 are fed to the first group level shift circuits 30 and to a first input terminal of the respective third group NAND circuits 28. Each of the first group level shift circuits 30 has an inverter function to output a drive signal to a corresponding analog switch 21 (connected to the first drive voltage input pad 2) for actuation thereof when the output of a corresponding first group NAND circuit 26 is at the low level. As a result, the first drive voltage signal VPP1 is applied to a corresponding output pad 14 through the actuated analog switch 21, thereby actuating a corresponding piezoelectric element of the ink jet printer.

As shown in FIG. 2, the first drive voltage signal VPP1 first drops from the level of the standby voltage signal VPP0 to 0V, then rises to a peak voltage VPP1max, and again drops to the level of the standby voltage signal VPP0. Thus, the deformation of the piezoelectric element decreases upon the first drop of the first drive voltage signal VPP1 to draw in a predetermined amount of ink, and then increases to discharge the sucked ink to form a printing dot on a printing medium (paper) upon the subsequent rise of the first drive voltage signal VPP1. As previously described, the peak voltage VPP1max of the first drive voltage signal VPP1 is lower than that of the second drive voltage signal VPP2, thereby forming a relatively small printing dot with a relatively small amount of discharged ink.

On the other hand, those bits of the secondary data S2 assigned to form printing dots are held at the high level. Thus, provided that the third input terminal is held at the high level, those of the second group NAND circuits 27 corresponding to the high level bits of the secondary data S2 produce a low level signal upon a rise of the strobe signal STR to the high level, whereas the remaining ones of the second group NAND circuits 27 corresponding to the low level bits of the secondary data S2 produce a high level signal.

The outputs of the second group NAND circuits 27 are fed to the second group level shift circuits 31 and to a second input terminal of the respective third group NAND circuits 28. Each of the second group level shift circuits 31 also has an inverter function to output a drive signal to a corresponding analog switch 21 (connected to the second drive voltage input pad 3) for actuation thereof when the output of a corresponding second group NAND circuit 27 is at the low level. As a result, the second drive voltage signal VPP2 is applied to a corresponding output pad 14 through the actuated analog switch 21, thereby actuating a corresponding piezoelectric element of the ink jet printer.

As shown in FIG. 2, the second drive voltage signal VPP2 first drops from an intermediate level VPP2mid to 0V, then rises to a peak voltage, VPP2max, and again drops to the level of the intermediate level VPP2mid. Thus, the deformation of the piezoelectric element decreases upon the first drop of the second drive voltage signal VPP2 to draw in a predetermined amount of ink, and then increases to discharge the sucked ink to form a printing dot on the printing paper upon the subsequent rise of the second drive voltage signal VPP2. As previously described, the peak voltage VPP2max of the second drive voltage signal VPP2 is higher than that of the first drive voltage signal VPP1, thereby forming a relatively large printing dot with a relatively large amount of discharged ink.

Each of the fourth group NAND circuits 29 is made to receive the outputs of corresponding flip-flops of the first and second latch circuits 24, 25. Thus, if the outputs of the corresponding flip-flops of the first and second latch circuits 24, 25 (i.e., the corresponding bits of the primary and secondary data S1, S2) are equally at the high level, the output of the fourth group NAND circuit 29 becomes low. As a result, the output of a corresponding second group NAND circuit 27 is held at a high level, thereby preventing the second drive voltage signal VPP2 from being applied to a corresponding output pad 14. In this way, the drive IC is designed such as to apply only the first drive voltage signal VPP1 even if the corresponding bits of the primary and secondary data S1, S2 are equally "1" due to an error in preparing these data, thereby preventing shorting between the first and second drive voltage input pads 2, 3.

The outputs of the first and second group NAND circuits 26, 27 are supplied to the fourth group NAND circuits 29, respectively. Thus, the output of the respective fourth group NAND circuits 29 becomes low when the outputs of both of the corresponding first and second group NAND circuits 26, 27 are high. As a result, the corresponding third group level shift circuit 30 having an inverter function causes the corresponding analog switch 21 to turn on, thereby feeding the standby voltage VPP0 to the corresponding output pad 14.

In summary, when the output of each first group NAND circuit 26 is low, a first drive voltage signal VPP1 is applied to the corresponding output pad 14. Similarly, the output of each second group NAND circuit 27 is low, a second drive voltage signal VPP2 is applied to the corresponding output pad 14. Otherwise, the standby voltage VPP0 is applied to the output pad 14.

Figure 3:
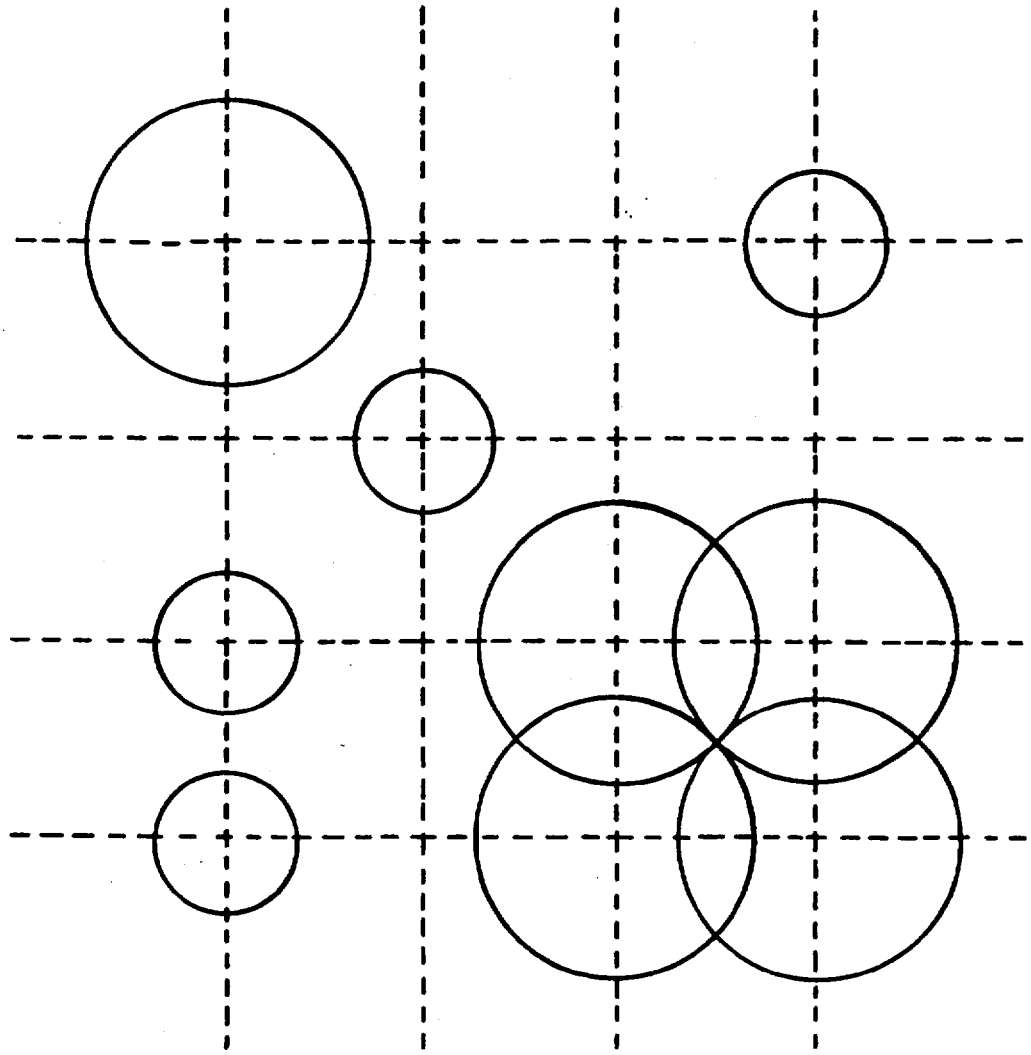
FIG. 3 is a view showing various dots formed on a recording medium by an ink jet printer driven by the drive IC of the present invention.

In this way, it is possible to form two different kinds of printing dots (smaller dots and larger dots) on the printing paper in accordance with the contents of the primary and secondary data S1, S2, as illustrated in FIG. 3 wherein the printing pitch is represented by broken lines. The contents of the primary and secondary data S1, S2 may be determined by the printer drive software of a personal computer in dependence on the contents of the original images. If necessary, the printer drive software may include error diffusion treatment for high-fidelity reproduction of the original images.

According to the illustrated embodiment, therefore, thicker image portions may be formed by larger printing dots with the selective application of second drive voltage signals VPP2, whereas thinner image portions may be formed by smaller printing dots with the selective application of first drive voltage signals VPP1. Thus, it is possible to realize an improvement of the gradating ability without any need for changing the printing pitch and time.

More specifically, the printing pitch may be enlarged to reduce the printing time, but yet thicker image portions can be formed with the selective application of second drive voltage signals VPP2 while forming thinner image portions with the selective application of first drive voltage signals VPP1. Thus, the total number of printing data may be reduced to realize a reduction of the printing time. For instance, assuming that larger printing dots correspond to a resolution of 360 dpi while smaller printing dots correspond to a resolution of 720 dpi, it was conventionally necessary to perform a printing operation with the 720 dpi resolution for making the dots of a thinner image portion non-outstanding. With the use of the drive IC of the present invention, by contrast, a thinner image portion may be formed by smaller printing dots with the 360 dpi resolution for realizing an image quality corresponding to the 720 dpi resolution. In this case, the printing speed may be quadrupled without making the dots of the thinner image portion outstanding.

The drive IC of the present invention may be used to form printing dots of an equal size alone. Specifically, if all primary data S1 fed to the first shift register 22 are made zero (0) while successively feeding suitable sets of secondary data S2 to the second shift register 23, an image may be formed solely by larger printing dots. On the other hand, if all secondary data S2 fed to the second shift register 23 are made zero (0) while successively feeding suitable sets of primary data S1 to the first shift register 22, an image may be formed solely by smaller printing dots.

The illustrated drive IC is designed to selectively provide two different kinds of printing dots However, a modification may be made to selectively provide three or more different kinds of printing dots by adding a third or further drive voltage input pad, a third or further shift register, a third or further latch circuit, and so on, thereby additionally improving the gradation capability of the ink Jet printer.

Further, according to the illustrated embodiment, the voltage level is set in the order of VPP0<VPP1<VPP2 to progressively increase the size of the printing dots with an increase of the drive voltage. However, the voltage level may be set in the order of VPP0>VPP1>VPP2 to progressively increase the size of the printing dots with a decrease of the drive voltage.

The present invention being thus described, it is obvious that the same may be varied in many ways. Such variations are not to be regarded as a departure from the spirit and scope of the invention, and all such variations as would be obvious to those skilled in the art are intended to be included within the scope of the following claims.

I claim:

1. A drive IC for driving piezoelectric elements of an ink jet printer comprising:

a plurality of drive output pads;

a plurality of data input pads for feeding plural kinds of drive data;

a plurality of shift registers each connected to a respective one of the data input pads, each of the shift registers having a plurality of bits corresponding in number to the plurality of drive output pads;

a plurality of analog switches divided into plural groups the analog switches in each group being connected to a respective one of the drive output pads; and selecting means connected to the shift registers for selectively feeding one of plural voltages to each of the drive output pads through a selected one of the analog switches in said each group;

wherein one of the analog switches in said each group is operated based on the drive data stored in one of the shift registers another of the analog switches in said each group being operated based on the drive data stored in another of the shift registers.

2. The drive IC according to claim 1, further comprising additional analog switches each connected to a corresponding one of the drive output pads, the selecting means serving to apply a standby voltage to each of the drive output pads via a corresponding one of the additional analog switches when neither of the plural voltages is fed to said each drive output pad.

3. The drive IC according to claim 1, further comprising a plurality of latch circuits each connected to a corresponding one of the shift registers for latching the drive data and for simultaneously feeding the latched drive data to the selecting means upon input of a strobe signal.

4. The drive IC according to claim 1, further comprising a plurality of data output pads each connected to a corresponding one of the shift registers for serial output of the drive data to a following drive IC.

5. The drive IC according to claim 1, wherein the selecting means further comprises means for exclusively feeding a predetermined one of the plural voltages to each of the drive output pads when corresponding bits of the plural kinds of drive data are equally an ON-signal in error.

* * * * *